US010100845B2

(12) United States Patent
Huang et al.

(10) Patent No.: US 10,100,845 B2
(45) Date of Patent: Oct. 16, 2018

(54) FAN

(71) Applicant: DELTA ELECTRONICS, INC., Taoyuan Hsien (TW)

(72) Inventors: Shih-Han Huang, Taoyuan Hsien (TW); Shun-Chen Chang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 462 days.

(21) Appl. No.: 14/326,776

(22) Filed: Jul. 9, 2014

(65) Prior Publication Data

US 2015/0044076 A1 Feb. 12, 2015

(30) Foreign Application Priority Data

Aug. 7, 2013 (CN) ..... 2013 1 0341962
May 12, 2014 (CN) ..... 2014 1 0197971

(51) Int. Cl.

*F04D 25/06* (2006.01)
*F04D 17/16* (2006.01)
*F04D 25/08* (2006.01)
*F04D 29/58* (2006.01)

(52) U.S. Cl.

CPC ..... *F04D 29/5806* (2013.01); *F04D 17/16* (2013.01); *F04D 25/0613* (2013.01); *F04D 25/082* (2013.01)

(58) Field of Classification Search

CPC ..... F04D 17/16; F04D 25/06; F04D 25/064; F04D 25/08; F04D 25/082; F04D 29/5806; F04D 29/584; H02K 9/04; H02K 9/06

USPC ..... 417/423.8; 310/12.29, 16

See application file for complete search history.

(56) References Cited

U.S. PATENT DOCUMENTS 4,337,406 A * 6/1982 Binder ..... H02K 7/003 310/112
6,028,379 A * 2/2000 Bertolini ..... H02K 5/24 248/604
6,384,494 B1 * 5/2002 Avidano ..... H02K 9/06 310/58
6,483,213 B1 * 11/2002 Hsu ..... H02K 3/522 310/68 R (Continued)

FOREIGN PATENT DOCUMENTS

WO WO99/07999 A1 2/1999

*Primary Examiner* — Charles Freay
*Assistant Examiner* — Lilya Pekarskaya
(74) *Attorney, Agent, or Firm* — Muncy, Geissler, Olds & Lowe, P.C.

(57) ABSTRACT

A fan includes a motor, an impeller and a heat-dissipating structure. The motor includes a stator magnet assembly, a frame, a first circuit board, and a cover. The frame supports the stator magnet assembly. The frame and the stator magnet assembly define a first accommodating space, and the first circuit board is disposed in the first accommodating space. The cover covers the first circuit board. The motor drives the impeller and the impeller includes a hub and a plurality of first blades. The hub has at least a heat-dissipating hole. The first blades are disposed around the hub, and the heat-dissipating structure is disposed at the outer side of the hub. The heat-dissipating structure has a baffle and at least a second blade extended from the baffle and located corresponding to the heat-dissipating hole.

19 Claims, 9 Drawing Sheets

(56) References Cited

U.S. PATENT DOCUMENTS

| | | | | |
|---|---|---|---|---|
| 6,713,907 | B2 * | 3/2004 | Matsumoto | F04D 25/0613 310/254.1 |
| 7,042,121 | B2 * | 5/2006 | De Filippis | F04D 25/082 310/52 |
| 7,211,914 | B2 * | 5/2007 | Hofmann | H02K 5/10 310/68 R |
| 8,212,439 | B2 * | 7/2012 | Dautel | F01P 5/02 310/58 |
| 8,313,282 | B1 * | 11/2012 | Jarrah | F04D 13/14 165/104.33 |
| 8,414,274 | B2 * | 4/2013 | Horng | F04D 25/0606 415/220 |
| 2006/0051221 | A1 * | 3/2006 | Chen | F04D 29/329 417/423.8 |
| 2008/0053639 | A1 * | 3/2008 | Lin | H05K 7/20172 165/80.3 |
| 2009/0196744 | A1 | 8/2009 | Yu et al. | |
| 2010/0178181 | A1 * | 7/2010 | Chen et al. | F04D 25/082 417/423.8 |

* cited by examiner

FAN

CROSS REFERENCE TO RELATED APPLICATIONS

This Non-provisional application claims priority under 35 U.S.C. § 119(a) on Patent Application No(s). 201310341962.9 and 201410197971.X filed in People's Republic of China on Aug. 7, 2013 and May 12, 2014, the entire contents of which are hereby incorporated by reference.

BACKGROUND OF THE INVENTION

Field of Invention

The present invention relates to a fan and, in particular, to a fan with a heat-dissipating structure.

Related Art

In a typical fan structure, the impeller is disposed on the motor, and the motor can drive the impeller to rotate. Accordingly, the fan can generate proper airflow to bring the heat of the heating element away. Thus, the manufacturers try to design a fan that can increase the airflow quantity as much as possible. To increase the rotation speed of a fan is a general method for enlarging the airflow quantity, but the rotation speed of a fan has physical limitation in practice. Because the blades of the fan will burden with an extremely high pressure during the high rotation speed, it causes the deformation or break of the blades. The undesired deformation or break of the blades can lead to a very dangerous situation.

Besides, the mechanism and bearing of the motor will bear a higher loading under high rotation speed, so the lifespan of the mechanism is highly threatened. Since the motor is surrounded by the impeller, the heat generated by the motor will be blocked by the impeller and can not be properly dissipated. This situation not only causes the damage of the motor bearing but also increases the temperature inside the system, thereby decreasing the lifespan of the motor as well as the fan.

In addition, some fans capable of generating high air pressure (e.g. a centrifugal fan) are usually applied to the heat-dissipating device of a complex system such as a telecom shelter, a VFD (Variable-frequency Drive) shelter or the likes. However, the heat-dissipating device of the complex system will generate an ambient temperature of 70° C., and the motor operating within the ambient temperature of 70° C. can reach a higher temperature up to 100° C. This high temperature will sufficiently reduce the lifespan of the motor bearing.

SUMMARY OF THE INVENTION

The present invention provides a fan configured with a heat-dissipating structure for motor, so that the heat generated by the motor can be effectively removed. Accordingly, the motor can operate under a reasonable temperature so as to improve the lifespan and safety of the motor as well as the fan.

To achieve the above objective, the present invention discloses a fan including a motor, an impeller and a heat-dissipating structure. The motor includes a stator magnet assembly, a frame, a first circuit board, and a cover. The frame supports the stator magnet assembly. The frame and the stator magnet assembly define a first accommodating space, and the first circuit board is disposed in the first accommodating space. The cover covers the first circuit board. The motor drives the impeller and the impeller includes a hub and a plurality of first blades. The hub has at least a heat-dissipating hole. The first blades are disposed around the hub, and the heat-dissipating structure is disposed at the outer side of the hub. The heat-dissipating structure has a baffle and at least a second blade extended from the baffle and located corresponding to the heat-dissipating hole.

In one embodiment, the hub has at least a recess extending from the heat-dissipating hole, and the second blade is engaged with the recess.

In one embodiment, the second blade is partially disposed in the recess and partially suspended above the heat-dissipating hole.

In one embodiment, the shape of the recess corresponds to the shape of a part of a bottom edge of the second blade.

In one embodiment, the hub has at least a first fixing portion, and the heat-dissipating structure has at least a second fixing portion connected to the first fixing portion. The first fixing portion and the second fixing portion can be connected by screwing, riveting or welding.

In one embodiment, the first blades and the second blade are airfoil blades, and the curvature directions of the first blades and the second blade are the same.

In one embodiment, the impeller further includes two annular structures. The first blades are disposed between the two annular structures, and one of the two annular structures is connected to the hub.

In one embodiment, the one of the two annular structures has a plurality of screw holes and is connected to the hub by screwing.

In one embodiment, the annular structure connected to the hub has a slant surface.

In one embodiment, the fan further has a shaft and an iron case, which are integrated to a body of the hub by die casting.

In one embodiment, the hub includes a light metal or an aluminum material.

In one embodiment, the fan further includes a base, and the frame and the base define a second accommodating space for receiving a second circuit board.

In one embodiment, the frame has at least a connecting hole, and the first circuit board and the second circuit board are electrically connected through the connecting hole.

In one embodiment, the second circuit board is a circuit board connecting to a power supply for providing a driving voltage to the first circuit board.

In one embodiment, the frame has a thermally conductive bump extending from the frame toward the surface of the second circuit board and contacting a part of the second circuit board.

In one embodiment, a waterproof glue or a silica gel is applied between the cover and the frame.

In one embodiment, the cover has at least a through hole, and an electronic device is disposed through the through hole.

In one embodiment, a waterproof glue is applied between the through hole and the electronic device or between the cover and the first circuit board.

In one embodiment, the electronic device includes a Hall sensor, a thermal fuse, or a wire.

In one embodiment, the cover has a restriction portion, and the first circuit board has a positioning recess corresponding to the restriction portion.

In one embodiment, the cover and the first circuit board are connected through at least a fixing element.

In one embodiment, when the fan includes a plurality of fixing elements, the positions of the fixing elements are asymmetrically arranged.

In one embodiment, the frame or the base has a fin.

In one embodiment, the frame has a bushing and an annular wall disposed around the bushing. The stator magnet assembly is telescoped to the bushing, and the bushing has a stop portion. When the stator magnet assembly is installed on the bushing, the stop portion maintains the stator magnet assembly at a fixed height.

In one embodiment, the frame is made of copper, iron, aluminum, or metal with high thermal conductivity.

In one embodiment, the cover is made of an insulation material.

As mentioned above, the fan of the invention has a hub configured with a heat-dissipating hole, and the heat-dissipating structure is located at the outside of the hub. Accordingly, when the motor drives the hub to rotate, the heat-dissipating structure will be rotated along with the blades. This motion can generate air convection around the hub and the motor so as to induce a second airflow for dissipating the heat of the motor through the heat-dissipating hole. Therefore, the coil of the motor as well and the bearing can be properly cooled down so as to increase the lifespan of the motor and the bearing.

The air inside the motor is guided along the second airflow to be exhausted through the heat-dissipating hole, and then dissipated to the environment by the rotation of the impeller. Compared with the conventional fan, the invention can decrease the retention zone and turbulent flow, and thus reduce the noise. The second airflow generated by the inner blades will flow inside the fan and only cost a small amount of energy. Besides, the heat-dissipating structure will not induce additional loading for the profile and power loss of the fan.

In addition, the configuration of the heat-dissipating hole can not only dissipate the heat of the motor but also decrease the weight of the hub.

Besides, if the inner blade is an airfoil blade and the curvature directions of the inner blade and the outer blade are the same, the inner blade and the outer blade will rotate along the same direction, thereby generating a reverse airflow (the second airflow) around the heat-dissipating hole. This configuration can exhaust the heat of the motor located inside the hub so as to increase the heat dissipation effect of the motor.

Moreover, a waterproof glue can be applied between the cover and the frame or between the cover and the first circuit board. This configuration can prevent moist and water from entering the fan when the fan is operated in a humid environment, thereby maintaining the lifespan of the circuit board.

BRIEF DESCRIPTION OF THE DRAWINGS

The present invention will become more fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
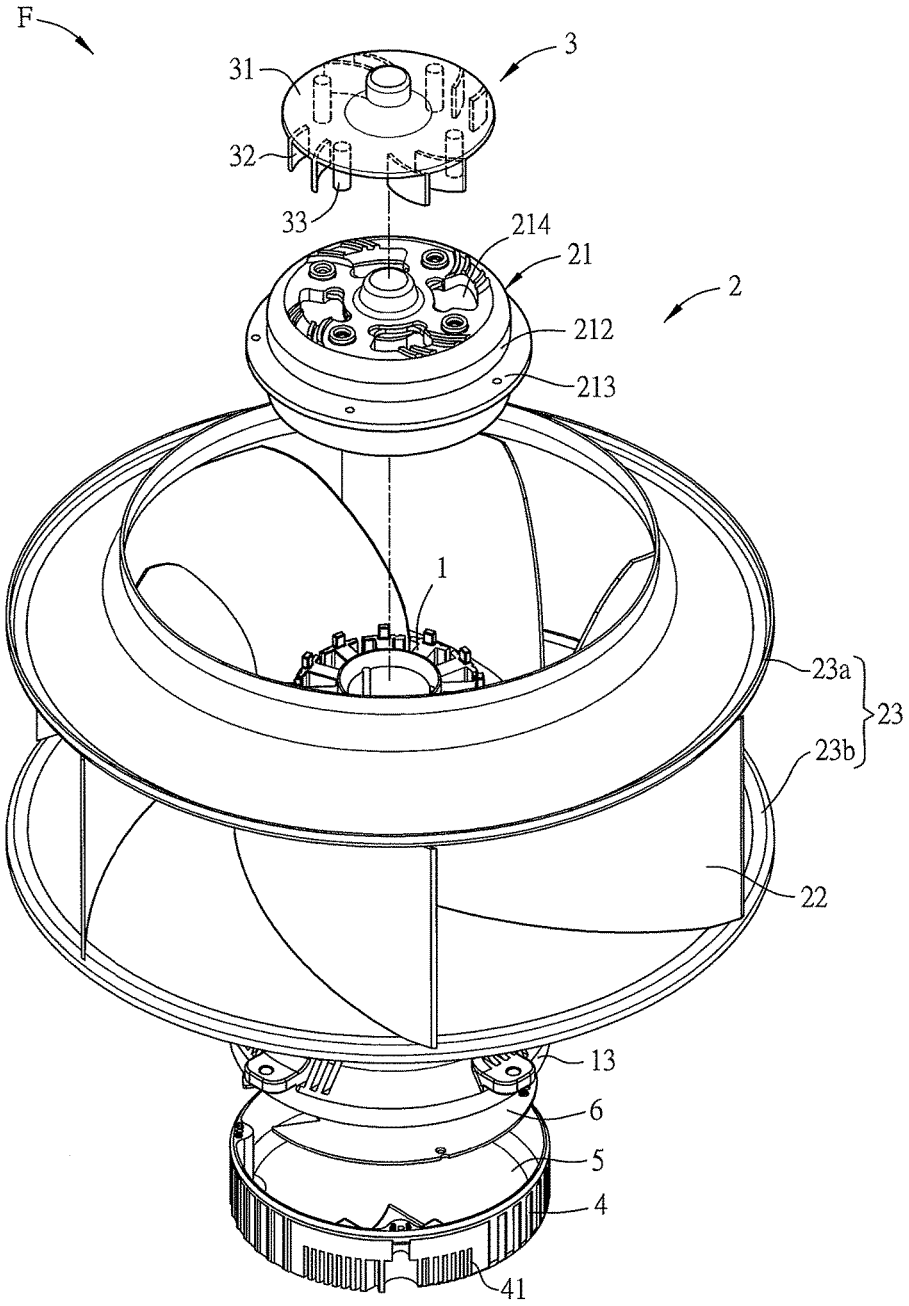
FIG. 1A is an exploded top view of a fan according to a preferred embodiment of the invention.
Figure 1B:
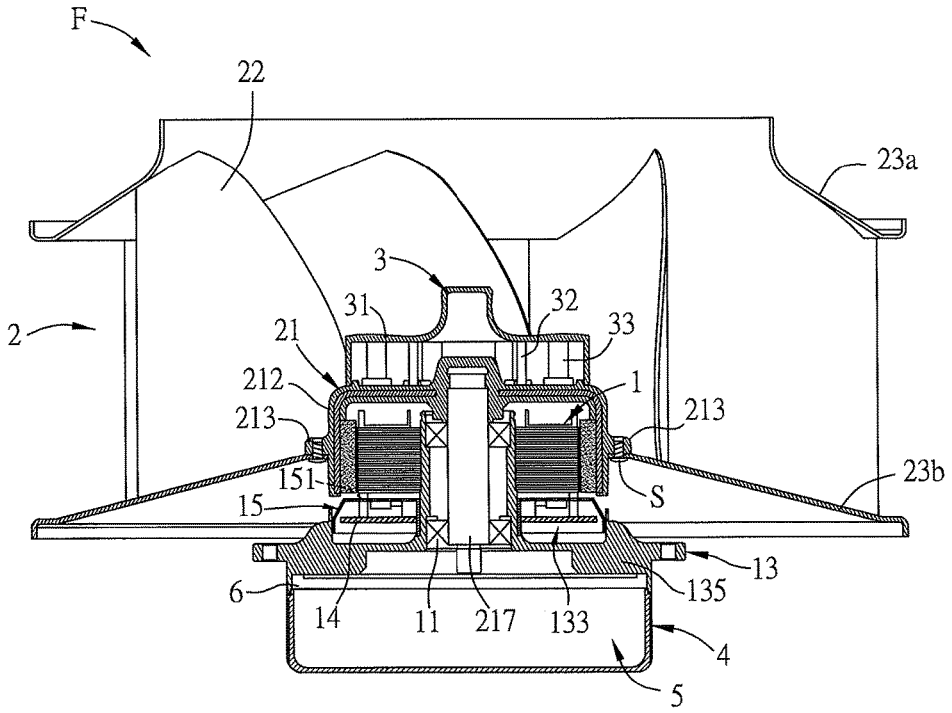
FIG. 1B is a sectional view of the fan of FIG. 1A.

FIG. 1A is an exploded top view of a fan F according to a preferred embodiment of the invention, and FIG. 1B is a sectional view of the fan F of FIG. 1A. Referring to FIGS. 1A and 1B, the fan F includes a motor 1, an impeller 2 and a heat-dissipating structure 3. The impeller 2 includes a hub 21 and a plurality of outer blades (first blades) 22. The hub 21 has a hollow structure for receiving the motor 1. The hub 21 includes a top portion 211 and a side wall 212 disposed around the top portion 211 as shown in FIG. 2.

With reference to FIGS. 1A and 1B, the impeller 2 further includes two annular structures 23, and the outer blades 22 are disposed between the two annular structures 23. One of the annular structures 23 is connected to the side wall 212 of the hub 21. In this embodiment, the annular structure 23 is composed of an upper annular structure 23*a* and a lower annular structure 23*b*, and the lower annular structure 23*b* is connected to the side wall 212 of the hub 21. Moreover, the hub 21 further includes a connecting portion 213. In more detail, the connecting portion 213 is a protrusion or platform extending from the side wall 212. The lower annular structure 23*b* has a plurality of screw holes so that the connecting portion 213 of the hub 21 can be connected to the lower annular structure 23*b* by screwing (using the screws S). Of course, this invention is not limited thereto.

The heat-dissipating structure 3 is also disposed at the outer side of the hub 21. In particular, the heat-dissipating structure 3 is disposed on the top portion 211 of the hub 21, and the top portion 211 of the hub 21 has at least one heat-dissipating hole 214. As shown in FIG. 2, the heat-dissipating structure 3 has a baffle 31 and at least one inner blade (second blade) 32. The inner blade 32 extends along the vertical direction from the baffle 31, and the position of the inner blade 32 corresponds to the heat-dissipating hole 214. In this embodiment, the top portion 211 of the hub 21 has four heat-dissipating holes 214, and the position of each heat-dissipating hole 214 corresponds to two inner blades 32. Accordingly, the heat-dissipating structure 3 of the embodiment includes eight inner blades 32. Of course, the numbers of the heat-dissipating holes 214 and the corresponding inner blades 32 are not limited in this invention. In addition, the hub 21 has at least one recess 215 extending along the radial direction from the heat-dissipating hole 214 and formed on the surface of the top portion 211 of the hub 21. The inner blade 32 is engaged with the recess 215 and crosses over the heat-dissipating hole 214. In other words, a part of the bottom edge of the inner blade 32 is located in the recess 215, while another part thereof is suspended over the heat-dissipating hole 214. In this embodiment, the number of the recesses 215 corresponds to the number of the inner blades 32. Accordingly, there are eight recesses 215 configured for engaging with the eight inner blades 32, thereby fixing the inner blades 32 so as to prevent the shift and vibration of the inner blades 32 as the fan F is in operation.

Figure 2:
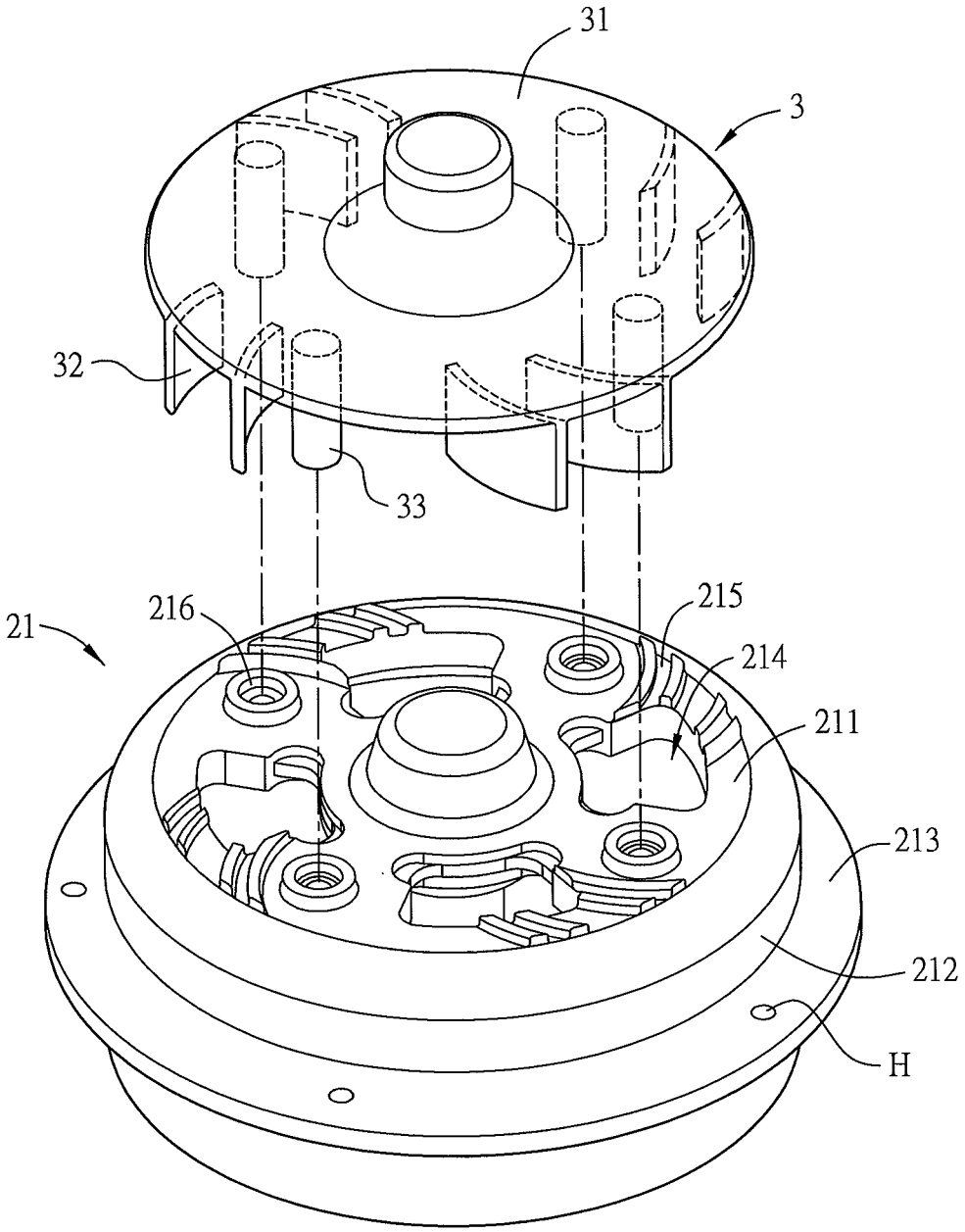
FIG. 2 is an enlarged view of the hub and the heat-dissipating structure of FIG. 1A.
Figure 3:
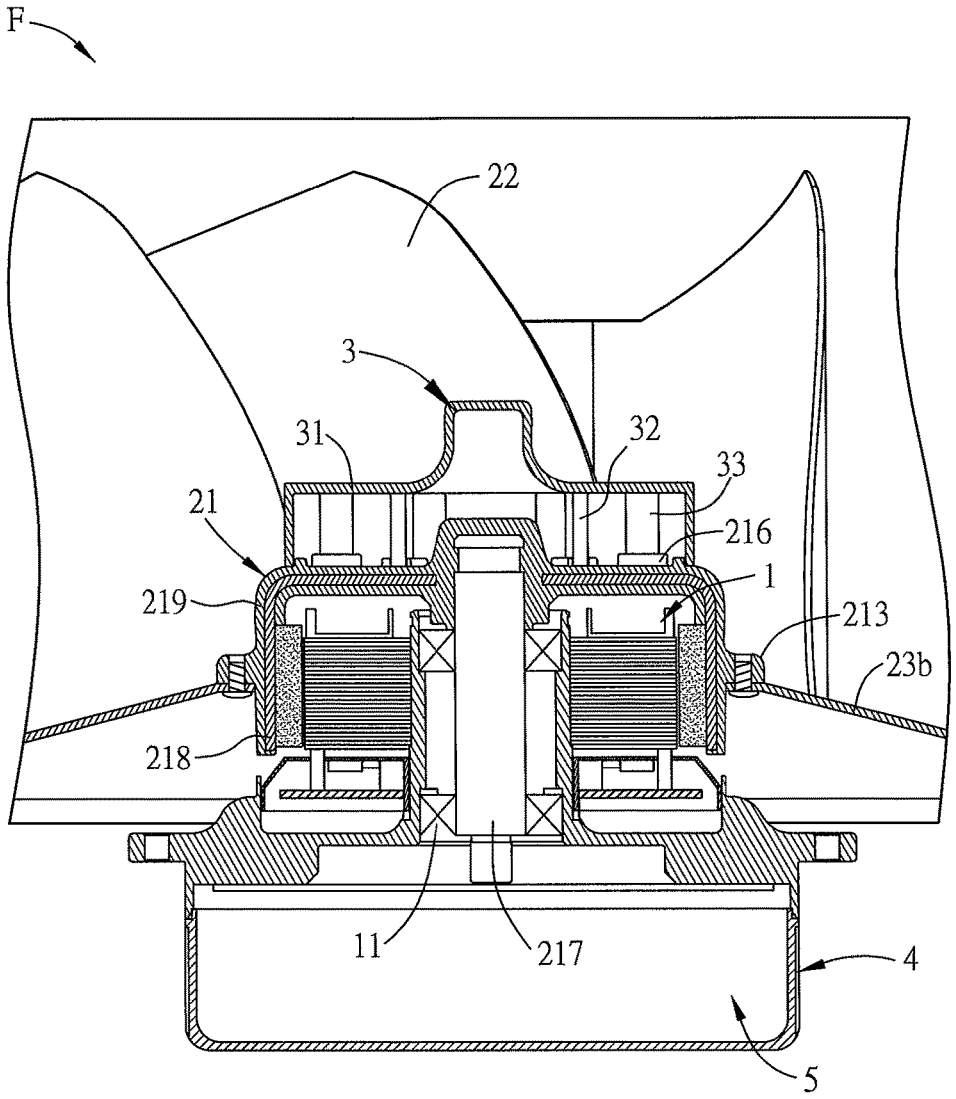
FIG. 3 is a partially enlarged view of the fan of FIG. 1B.

Referring to FIG. 2, the hub 21 has at least one first fixing portion 216, and the heat-dissipating structure 3 has at least one second fixing portion 33, which connects to the first fixing portion 216 (see FIG. 3). In this embodiment, the second fixing portion 33 is a screw bolt extending vertically and downwardly from the baffle 31. The extending direction of the second fixing portion 33 is parallel to the inner blade 32. The first fixing portion 216 is a screw hole corresponding to the second fixing portion 33 so that the first fixing portion 216 and the second fixing portion 33 can be connected to each other by screwing. Of course, in other embodiments, the first fixing portion 216 and the second fixing portion 33 can be connected by other methods such as riveting or welding, and this invention is not limited.

FIG. 3 is a partially enlarged view of the fan F of FIG. 1B. Referring to FIG. 3 in view of FIG. 1B, the impeller 2 is coupled to the motor 1, and the motor 1 drives the impeller 2 to rotate. Accordingly, when the fan F is in operation, the motor 1 drives the impeller 2 to rotate. The fan F has a shaft 217 and an iron case 218. In this embodiment, the shaft 217 and the iron case 218 are integrated to a body 219 of the hub 21 by die casting. To be noted, the body 219 of the hub 21 includes the top portion 211, the side wall 212, the connecting portion 213, the heat-dissipating hole 214, the recess 215 and the first fixing portion 216 as shown in FIG. 2. To make the following description more clear and simple, these components are combined and called a body 219. In more detail, the shaft 217, the iron case 218 and the body 219 are integrally formed by ejection molding so as to form the main structure of the hub 21, and the connection portion of the shaft 217, the iron case 218 and the hub 21 are formed by die casting. The body 219 of the hub 21 is made of a light metal, preferably an aluminum material. In this embodiment, the shaft 217 and the iron case 218 are made of iron material, and they are integrally formed with the aluminum body 219 by ejecting molding so as to form the hub 21. The connection portion of the shaft 217, the iron case 218 and the body 219 is strengthened by die casting. Compared with the conventional art that uses the way of riveting, fitting or iron ring to connect the plastic hub and the iron shaft, the present embodiment using die casting to connect the shaft 217 and the body 219 can further increase the connection intensity.

Figure 4:
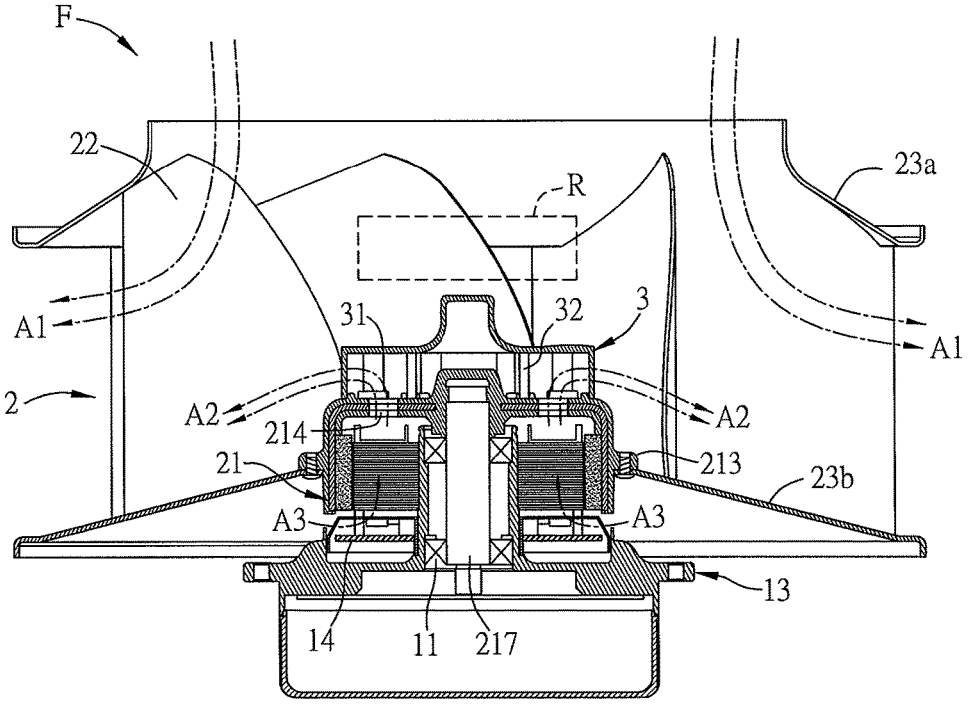
FIG. 4 is a sectional view of the fan of FIG. 1B, which shows the airflow directions.
Figure 5:
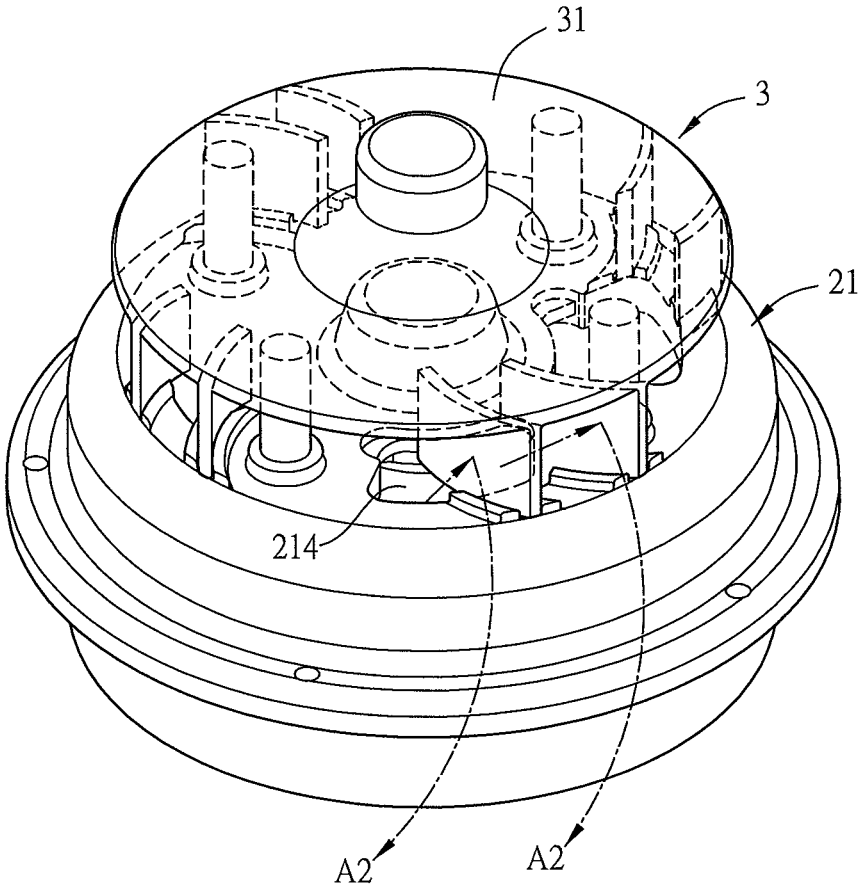
FIG. 5 is a perspective view of the assembly of the hub and the heat-dissipating structure of FIG. 2.

The motor 1 has a bearing 11, and the shaft 217 is supported by the bearing 11. When the motor 1 is in operation, the hub 21 is driven so as to carry the impeller 2 to rotate. FIG. 4 is a sectional view of the fan F of FIG. 1B, which shows the airflow directions, and FIG. 5 is a perspective view of the assembly of the hub 21 and the heat-dissipating structure 3 of FIG. 2. Referring to FIGS. 3-5, when the motor 1 drives the impeller 2 to rotate, the outer blades 22 will rotate to generate the first airflow A1 to provide the necessary airflow quantity. At the same time, the hub 21 carries the inner blades 32 to rotate so as to generate a convection effecting around the hub 21 and the motor 1, thereby generating the second airflow A2. Accordingly, the heat of the motor 1 can be dissipated through the heat-dissipating hole 214 as shown in FIGS. 4 and 5 so that the coil of the motor 1 as well as the bearing 11 can be cooled down, thereby increasing the lifespan of the motor 1 and the bearing 11. The second airflow A2 generated by the inner blades 32 will flow inside the fan F and only cost a small amount of energy. Thus, the heat-dissipating structure 3 will not induce additional loading for the profile and power loss of the fan F. In addition, the configuration of the heat-dissipating hole 214 can not only dissipate the heat of the motor 1 but also decrease the weight of the hub 21. Moreover, since the body 219 of the hub 21 is made of aluminum (see FIG. 3), the weight of the hub 21 can be further decreased.

In the conventional centrifugal fan, the inlet and outlet of the impeller are usually configured with a turn of large angle, which can easily generate turbulent flows. The undesired turbulent flows will block the airflow field and decrease the performance. In the fan F of the embodiment as shown in FIG. 4, the connection portion of the impeller 2 and the hub 21 is close to the inner blades 32. In other words, the positions of the lower annular structure 23*b* and the connecting portion 213 are close to the inner blades 32. The lower annular structure 23*b* connecting to the hub 21 further has a slant surface. This arrangement and the configuration of the slant surface allow the first airflow A1 more smooth, thereby decreasing the turbulent flow generated at the turns.

In addition, when the conventional fan is in operation, the air above the hub will not flow, thus forming a stagnation area. In this invention, the hub 21 has a heat-dissipating hole 214, and the heat-dissipating structure 3 is disposed on the hub 21 corresponding to the heat-dissipating hole 214 for generating the second airflow A2. Accordingly, the air inside the motor 1 can be guided along the second airflow A2 to be exhausted through the heat-dissipating hole 214, and then dissipated to the environment by the rotation of the impeller 2. Compared with the conventional fan, the present invention can decrease the stagnation zone R and turbulent flow so as to reduce the noise.

Besides, the heat-dissipating structure 3 is further provided with a baffle 31 so that the heat-dissipating hole 214, the inner blades 32 and the baffle 31 form a complete channel for the second airflow A2. This can prevent the air above the heat-dissipating structure 3 from being attracted by the second airflow A2, thereby ensuring that the second airflow A2 comes from the air around the motor 1. Such a design can further improve the efficiency of exhausting the heat generated by the motor 1.

In this embodiment, the inner blade 32 is an airfoil blade, and the curvature directions of the inner blade 32 and the outer blade 22 are the same. Accordingly, when the outer blade 22 rotates, the inner blade 32 and the outer blade 22 will rotate along the same direction, thereby generating a reverse airflow (the second airflow A2) around the heat-dissipating hole 214. It can exhaust the heat of the motor 1 located inside the hub 21 so as to increase the heat dissipation effect of the motor 1. Besides, the shape of the recess 215 corresponds to that of partial bottom edge of the inner blade 32. In other words, the recess 215 has a specific curve corresponding to the curvature of the inner blade 32 so that the inner blade 32 can be engaged with the recess 215 along a fixed direction. This can ensure that the direction of the inner blade 32 can match with that of the outer blade 22 when the heat-dissipating structure 3 is installed on the hub 21, thereby preventing the wrong installation (foolproof function).

Figure 6A:
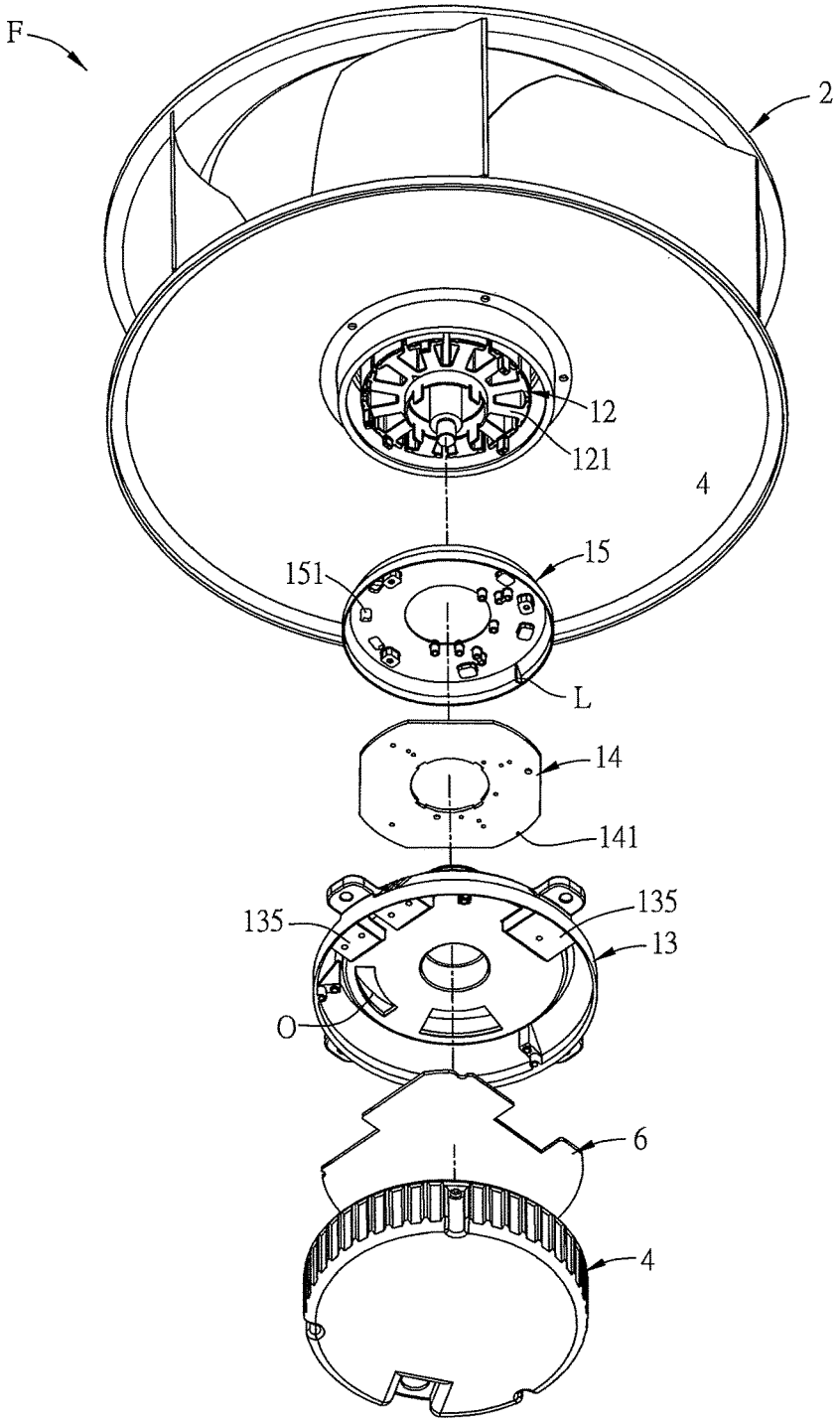
FIG. 6A is an exploded bottom view of the fan of FIG. 1A.
Figure 6B:
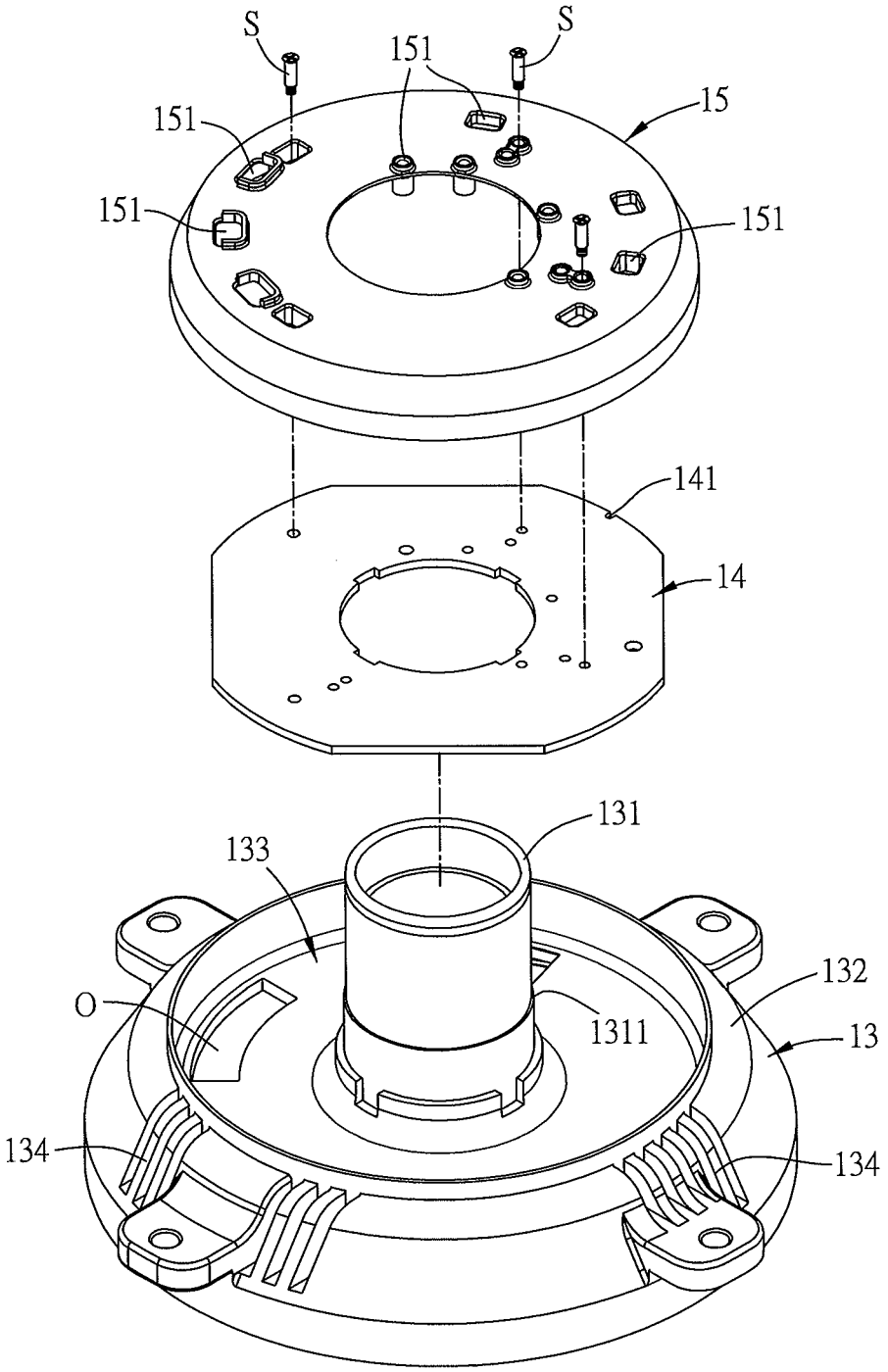
FIG. 6B is an exploded view of the frame and the cover of FIG. 6A.
Figure 6C:
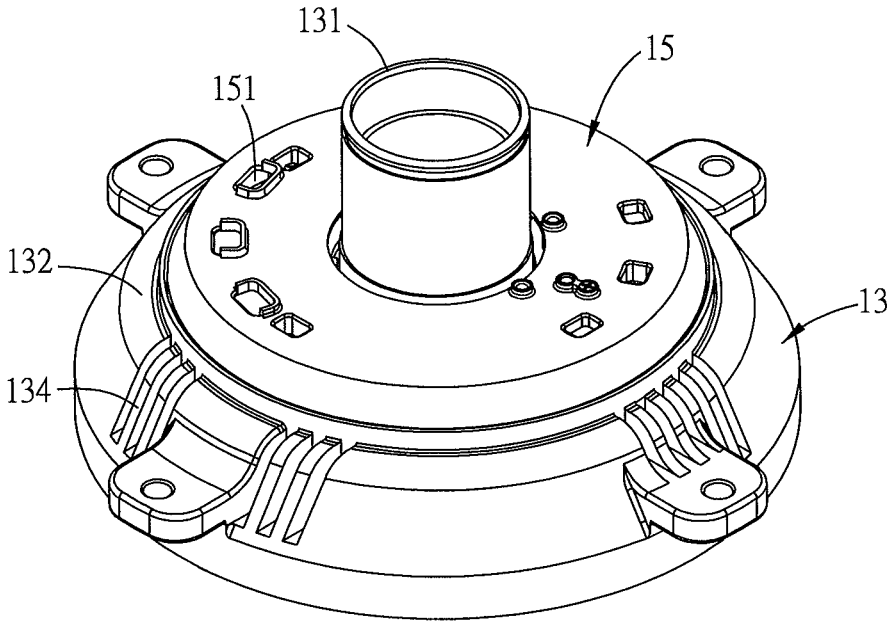
FIG. 6C is a schematic diagram showing the assembly of the elements shown in FIG. 6B.

FIG. 6A is an exploded bottom view of the fan F of FIGS. 1A and 1B, FIG. 6B is an exploded view of the frame 13 and the cover 15, and FIG. 6C is a schematic diagram showing the assembly of the elements shown in FIG. 6B. Referring to FIGS. 5, 6A, 6B and 6C, the motor 1 includes a stator magnet assembly 12, a frame 13, a first circuit board 14 and a cover 15. The stator magnet assembly 12 has a plurality of pole arms 121 wound by a plurality of coils. This invention is not to limit the number of the pole arms, and the stator magnet assembly 12 of the embodiment has twelve pole arms 121. Besides, the motor 1 of the embodiment is a three-phase motor. Of course, the motor 1 can be a single-phase motor.

As shown in FIG. 6B, the frame 13 has a bushing 131 and an annular wall 132 disposed around the bushing 131. The stator magnet assembly 12 is telescoped to the bushing 131 of the frame 13. The bushing 131 has a stop portion 1311. When the stator magnet assembly 12 is installed on the bushing 131, the stop portion 1311 maintains the stator magnet assembly 12 at a fixed height and is not directly attached to the frame 13. Herein, a first accommodating space 133 is defined between the stator magnet assembly 12 and the annular wall 132 of the frame 13.

The first circuit board 14 is disposed in the first accommodating space 133. The first circuit board 14 is used for driving the motor 1 to operate, and the coils winding around the pole arms 121 are electrically connected to the first circuit board 14. In addition, the first circuit board 14 is telescoped to the bushing 131 to be received in the first accommodating space 133. Herein, the cover 15 is also telescoped to the bushing 131 to cover the first circuit board 14.

The cover 15 and the first circuit board 14 can be connected by at least one fixing element. In this embodiment, the cover 15 is fastened on the first circuit board 14 by three screws (fixing elements) S. The positions of the screws S can be asymmetrically arranged so that the cover 15 can be correctly installed on the first circuit board 14. Of course, the cover 15 and the first circuit board 14 can also be connected by a single fixing element, and any firmly connection is acceptable. As shown in FIG. 6A, the cover 15 has a restriction portion L, and the first circuit board 14 has a positioning recess 141 corresponding to the restriction portion L to ensure that the positioning recess 141 is engaged with the restriction portion L while installing the first circuit board 14 and the cover 15.

The cover 15 has at least one through hole 151. The coils can be electrically connected to the first circuit board 14 through the through hole 151. For example, if the motor 1 is a three-phase motor, the three coils U, V and W can be connected to the first circuit board 14 through three through holes 151, respectively. Besides, the through hole 151 can also be configured for installing other electronic devices such as Hall sensor, thermal fuse or other wires. Accordingly, the electronic device can pass through the through hole 151 to be disposed on the first circuit board 14 or be connected to the stator magnet assembly 12. Moreover, the cover 15 is made of an insulation material so as to prevent the short circuit between the stator magnetic assembly 12 and the electronic device of the first circuit board 14.

In order to prevent the moist from entering the first accommodating space 133 to damage the first circuit board 14, a waterproof glue can be applied between the cover 15 and the annular wall 132 of the frame 13 after the cover 15 covers the first circuit board 14. The waterproof glue can fully fill the gap between the annular wall 132 and the frame 13 so as to provide an excellent waterproof function. The waterproof glue can be a silica gel, but this invention is not limited thereto. Similarly, the waterproof glue can be applied between the through hole 151 of the cover 15 and the electronic devices.

In addition, the frame 13 has a fin 134. Referring to FIG. 6B in view of FIG. 4, the fins 134 are disposed on the annular wall 132 of the frame 13. When the fan F operates to generate the second airflow A2, which can exhaust the heat inside the hub 21, a third airflow A3 flowing from the outside of the hub 21 toward the inside of the hub 21 can be generated at the gap between the hub 21 and the cover 15. The third airflow A3 can bring the heat generated by the first circuit board 14 to the inside of the hub 21, and then the heat can be dissipated by the second airflow A2. This design can protect the first circuit board 14 from overheat and damage. Herein, the fins 134 can enhance the heat dissipation effect of the third airflow A3.

Referring to FIGS. 1B and 6A, the fan F of the embodiment further includes a base 4. The motor 1 is disposed on the base 4, and the frame 13 and the base 4 define a second accommodating space 5 for receiving a second circuit board 6. The second accommodating space 5 is an electric room, and the second circuit board 6 is connected to the power supply and has the functions of modulation, filtering or rectification for providing a driving voltage to the first circuit board 14. Herein, the frame 13 has at least one connecting hole O, and the first circuit board 14 and the second circuit board 6 are electrically connected via the connecting hole O. Besides, the connecting hole O can be used for air convection and heat dissipation. Since the connecting hole O is located between the first accommodating space 133 and the second accommodating space 5, the cover 15 can also prevent the moist from entering the second accommodating space 5 and damaging the second circuit board 6.

In addition, as shown in FIG. 6A, the frame 13 further has a thermally conductive bump 135 extending from the frame 13 toward the surface of the second circuit board 6 and contacting a part of the second circuit board 6. Herein, the frame 13 is made of metal material such as, for example but not limited to, copper, iron, aluminum, or any metal with high thermal conductivity. Accordingly, the thermally conductive bump 135 contacted the electronic devices on the second circuit board 6 can bring the heat generated by the second circuit board 6 to the frame 13, which can be then dissipated through the above-mentioned third airflow A3.

As shown in FIG. 1A, the base 4 can further include fins 41, which are configured at the outer side of the base 4 for assisting in dissipating the heat of the second circuit board 6 in the second accommodating space 5. Of course, the base 4 can also be made of copper, iron, aluminum, or any metal with high thermal conductivity, thereby increasing the heat dissipation efficiency of the electronic device and providing the function of resisting external noise to the internal circuits.

In general, when the conventional centrifugal fan of 360 mm diameter operates for 10 minutes (720 W, 2000 RPM) at room temperature (about 20° C.), the coil temperature of the motor will rise up to 100° C. or more if the fan is still operating. Under the same conditions, the fan F of the invention also operates for 10 minutes, the coil temperature of the motor 1 can be remained below 50° C. As a result, the design of the present invention can exactly dissipate the heat generated by the motor 1.

In summary, the fan of the invention has a hub with a heat-dissipating hole, and the heat-dissipating structure is located at the outside of the hub. Accordingly, when the motor drives the hub to rotate, the heat-dissipating structure will be rotated along with the blades. This motion can generate the air convection around the hub and the motor so as to induce a second airflow for dissipating the heat of the motor through the heat-dissipating hole. Therefore, the coil of the motor as well and the bearing can be properly cooled down so as to increase the lifespan of the motor and the bearing.

The air inside the motor is guided along the second airflow to be exhausted through the heat-dissipating hole by the rotation of the impeller. Compared with the conventional fan, the invention can decrease the stagnation zone and turbulent flow, and thus reduce the noise. The second airflow generated by the inner blades will flow inside the fan and only cost a small amount of energy. Besides, the heat-dissipating structure will not increase additional loading for the profile and power loss of the fan.

In addition, the heat-dissipating hole can not only dissipate the heat of the motor but also decrease the weight of the hub.

Besides, if the inner blade is an airfoil blade and the curvature directions of the inner and outer blades are the same, the inner and outer blades will rotate along the same direction, thereby generating a reverse airflow (the second airflow) around the heat-dissipating hole. It can exhaust the heat of the motor inside the hub so as to increase the heat dissipation effect of the motor.

Moreover, a waterproof glue can be applied between the cover and the frame or between the cover and the first circuit board to prevent moist and water from entering the fan when the fan is operated in a humid environment, thereby maintaining the lifespan of the circuit board.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. A fan comprising:

a motor comprising:

a stator magnet assembly, a frame for supporting the stator magnet assembly, wherein the frame and the stator magnet assembly define a first accommodating space, a first circuit board disposed in the first accommodating space, and a cover covering the first circuit board, wherein the cover has a restriction portion, and the first circuit board has a positioning recess corresponding to the restriction portion;

an impeller driven by the motor and comprising:

a hub having at least a heat-dissipating hole, and a plurality of first blades disposed around the hub; and a heat-dissipating structure disposed at the outer side of the hub, wherein the heat-dissipating structure has a baffle and at least a second blade which is extended from the baffle and located corresponding to the heat-dissipating hole;

wherein a plurality of thermally conductive bumps and a plurality of fins are respectively disposed on two sides of the frame, wherein the hub has at least a recess extending from the heat-dissipating hole, the second blade is engaged with the recess, the second blade is partially disposed in the recess and partially suspended above the heat-dissipating hole, and a shape of the recess corresponds to a shape of a part of a bottom edge of the second blade.

2. The fan of claim 1, wherein the hub has at least a first fixing portion, the heat-dissipating structure has at least a second fixing portion, and the first fixing portion and the second fixing portion are connected by screwing, riveting or welding.

3. The fan of claim 1, wherein the first blades and the second blade are airfoil blades, and curvature directions of the first blades and the second blade are the same.

4. The fan of claim 1, wherein the impeller further comprises two annular structures, the first blades are disposed between the two annular structures, and one of the two annular structures is connected to the hub, and wherein the one of the two annular structures has a plurality of screw holes and is connected to the hub by screwing.

5. The fan of claim 4, wherein the annular structure which is connected to the hub has a slant surface.

6. The fan of claim 1, further comprising a shaft and an iron case, wherein the shaft and the iron case are integrated to a body of the hub by die casting.

7. The fan of claim 1, wherein the hub comprises a light metal or an aluminum material.

8. The fan of claim 1, further comprising a base, wherein the frame for supporting the stator magnet assembly and the base define a second accommodating space for receiving a second circuit board.

9. The fan of claim 8, wherein the frame has at least a connecting hole, and the first circuit board and the second circuit board that are electrically connected through the connecting hole.

10. The fan of claim 8, wherein the second circuit board is a circuit board connecting to a power supply for providing a driving voltage to the first circuit board.

11. The fan of claim 10, wherein the thermally conductive bumps extend from the frame toward the surface of the second circuit board and contact a part of the second circuit board.

12. The fan of claim 1, wherein a waterproof glue or a silica gel is applied between the cover and the frame.

13. The fan of claim 1, wherein the cover has at least a through hole, and an electronic device is disposed through the through hole.

14. The fan of claim 13, wherein a waterproof glue is applied between the through hole and the electronic device or between the cover and the first circuit board.

15. The fan of claim 13, wherein the electronic device comprises a Hall sensor, a thermal fuse, or a wire.

16. The fan of claim 1, wherein the cover and the first circuit board are connected through at least a fixing element.

17. The fan of claim 8, wherein a fin is disposed on an outer surface of the base.

18. The fan of claim 1, wherein the frame has a bushing and an annular wall disposed around the bushing, the stator magnet assembly is telescoped to the bushing, and the bushing has a stop portion, wherein when the stator magnet assembly is installed on the bushing, the stop portion maintains the stator magnet assembly at a fixed height.

19. The fan of claim 1, wherein the frame is made of copper, iron, aluminum, or metal with high thermal conductivity, and the cover is made of an insulation material.

* * * * *